United States Patent [19]

Berry et al.

[11] 4,406,456

[45] Sep. 27, 1983

[54] METHOD OF RESURFACING A BOWLING LANE AND PRODUCT OF SAID METHOD

[75] Inventors: Foster W. Berry; Robert Torresen, both of Muskegon; David M. Boruta, Grand Haven, all of Mich.

[73] Assignee: Brunswick Corporation, Skokie, Ill.

[21] Appl. No.: 350,003

[22] Filed: Feb. 18, 1982

Related U.S. Application Data

[63] Continuation of Ser. No. 35,266, May 1, 1979, abandoned, which is a continuation-in-part of Ser. No. 966,380, Dec. 4, 1978, abandoned.

[51] Int. Cl.[3] ..... A63D 1/04; A63D 1/08

[52] U.S. Cl. ..... 273/51; 52/126.6; 52/309.1; 144/347; 156/61; 156/71; 156/94; 428/204; 428/425.1; 428/525; 428/528; 428/529

[58] Field of Search ..... 52/126, 309.1; 144/309 P, 309 Q; 156/61, 71, 94; 273/51; 428/425.1, 525, 528, 529, 204

[56] References Cited

U.S. PATENT DOCUMENTS

| | | | |
|---|---|---|---|
| 2,605,205 | 7/1952 | Patterson et al. | 428/204 X |
| 2,816,851 | 12/1953 | Arledter | 428/204 X |
| 3,135,643 | 6/1964 | Michl | 428/204 X |
| 3,373,070 | 3/1968 | Fuerst | 428/204 X |
| 3,373,071 | 3/1968 | Fuerst | 428/204 X |
| 4,205,842 | 6/1980 | Murrey | 273/51 |
| 4,205,843 | 6/1980 | Murrey | 273/51 |
| 4,231,573 | 11/1980 | Kelly | 273/51 |
| 4,307,883 | 12/1981 | Kelly | 273/51 |

*Primary Examiner*—Michael R. Lusignan
*Attorney, Agent, or Firm*—Wood, Dalton, Phillips, Mason & Rowe

[57] ABSTRACT

A method of resurfacing a worn wooden bowling lane comprises the steps of (a) smoothing the worn lane surface to a uniform level, (b) securing suitable underlayment panels to the surface of selected lane sections exposed to direct ball impact, (c) securing decorative panels of intermediate-density resin-bonded particle board to the surface of the remaining lane sections exposed only to rolling ball contact, and (d) securing a decorative, impact- and abrasion-resistant plastic laminate to the underlayment panels. The decorative panels simulate the appearance and bowling characteristics of natural wooden lanes.

21 Claims, 8 Drawing Figures

7
7
20
20
30
54
54
60
65
65
66
68
68
71
80
100
101
102
104
106
110
110
112
112
114
114
114
116
116
118
118
120
122
122
122
124
124
126
126
126
128
128
130
130
130
131
131
132
132
134
134
135
135
136
136
138
139
140
140
141
142
142
143
144
146
146
148
148
150
150
18b

METHOD OF RESURFACING A BOWLING LANE AND PRODUCT OF SAID METHOD

CROSS-REFERENCE TO RELATED APPLICATION

This is a continuation of application Ser. No. 35,266, filed May 1, 1979, now abandoned, which is a continuation-in-part of application Ser. No. 966,380, filed Dec. 4, 1978, now abandoned.

BACKGROUND OF THE INVENTION

This invention relates to synthetic bowling surfaces and methods of refinishing wooden bowling surfaces. More specifically, this invention relates to a method of resurfacing a worn wooden bowling lane with a sectionalized surface comprising underlayment panels of a suitable shock-absorbing material, such as phenol-formaldehyde, resin-bonded particle board, for example, and a synthetic laminate.

Heretofore, bowling lanes have generally been constructed of transversely laminated longitudinally extending wooden strips having a lacquered bowling surface. The approach and head sections of the lane were of relatively hard maple and terminated in a splice with one of several relatively soft pine sections. The pine sections terminated at a highly impact- and abrasion-resistant pin deck.

As is well known in the art, the wooden strips are of random lengths and are secured to each other by mechanical means, such as nails, and by adhesives. A substantial lane thickness is required to allow periodic resurfacing thereof. Lane fabrication is usually conducted on-site and is laborious, time-consuming and expensive, and is further complicated by the requirement that the bowling surface be substantially level and that the surface characteristics be substantially uniform.

Wooden bowling lanes are characterized by a number of functional disadvantages. Since various surface characteristics of natural wood may be controlled only to a limited degree, the surface appearance and bowling characteristics of wooden lanes may be non-uniform from lane to lane and within an individual lane.

More significantly, wooden lane surfaces become worn and require periodic resurfacing, generally performed annually, comprising sanding of the surface to a uniform level to eliminate cracks, grooves and other damage, followed by relacquering. The resurfacing operation generally requires a shut-down of the bowling establishment of at least one day. The sanding and relacquering operation creates substantial debris and, more significantly, is dangerous due to the flammable or explosive nature of the lacquers typically best suited for lane refinishing.

Annual lane refinishing is time-consuming and expensive due to several factors. Revenue is foregone during the required shut-down of the bowling establishment, and the direct material and labor costs of resurfacing and clean-up are significant. The fire and explosion risks associated with the use of resurfacing lacquers tend to significantly increase the bowling proprietor's casualty insurance premiums.

The expected life of conventional wooden lanes varies from between 20 to about 30 years. Due to yearly resurfacing, the lane thickness decreases until the nails joining the lane's wooden strips are exposed, rendering the lane unusable. Areas of heavy ball impact, such as the head sections, are subjected to relatively great amounts of stress and therefore may become damaged before other lane sections. The degree of wear experienced by a given lane section controls the level to which the entire lane must be sanded during resurfacing.

Since wooden lane surfaces are constructed of wooden strips of random length, removal and replacement of a lane section is generally impractical. An entire lane must generally be replaced when one section has become so badly worn as to reduce the lane level to an unusable point. As a result, replacement of an entire lane often involves removal of one or more relatively undamaged lane sections, resulting in significant waste.

It has been suggested that worn wooden lanes may be resurfaced by the application of decorative synthetic laminate panels, such as panels of a cellulose/-melamineformaldehyde/Kraft paper composite similar to laminates marketed under the trademark Formica, directly to the lane surface. However, it has been found that a wooden lane provides a poor support for such a laminate surface since wood is relatively easily permanently deformed by the impact of a lofted bowling ball. Such deformation in turn allows deformation of the laminate, resulting in cracking and denting thereof.

Further, badly worn lanes require removal of nails therefrom to allow resurfacing, resulting in momentary flexing of the unsecured wooden strips thereof upon impact by a bowling ball. Such flexing has been found to result in longitudinal cracking of overlying laminate panels.

SUMMARY OF THE INVENTION

The present invention is directed to overcoming one or more of the problems as set forth above.

The present invention provides a method of resurfacing a worn wooden bowling lane in order to provide a durable bowling surface of consistent appearance and bowling characteristics which requires relatively little maintenance and which eliminates periodic lane resurfacing.

According to the present invention, a worn wooden bowling lane is smoothed, as by sanding, in order to provide a smooth and substantially level substrate for support of a series of longitudinally extending synthetic panels. The panels corresponding to the lane's maple head and approach sections are of a relatively high density, have desirable hardness, tensile strength and stiffness characteristics to distribute bowling ball impact, and support decorative surface panels of a highly impact- and abrasion-resistant synthetic laminate.

The panels corresponding to the pine lane sections are of intermediate density and have an integral, decorative upper surface with an impact-resistant coating. The decorative surfaces of the synthetic laminate and the intermediate-density particle board may be printed to simulate the appearance of maple and pine, as desired. Means are provided for assuring that the surface levels of the respective sections are uniform.

A foul line is received by a transversely extending groove in the wooden substrate and extends upwardly therefrom between the approach and head sections. A simulated splice section is silk-screened on the head surface at the interface of the rearmost head section and the forwardmost pine section.

The pin deck comprises a heavy-duty laminate of high-density particle board with upper and lower surface laminates, similar to those of the maple sections.

Wooden lanes may be resurfaced according to the invention during an overnight work period and thus, no shut-down of the bowling establishment is required. Further, only minimal lane maintenance is required.

DETAILED DESCRIPTION OF THE PREFERRED EMBODIMENTS

Figure 1:
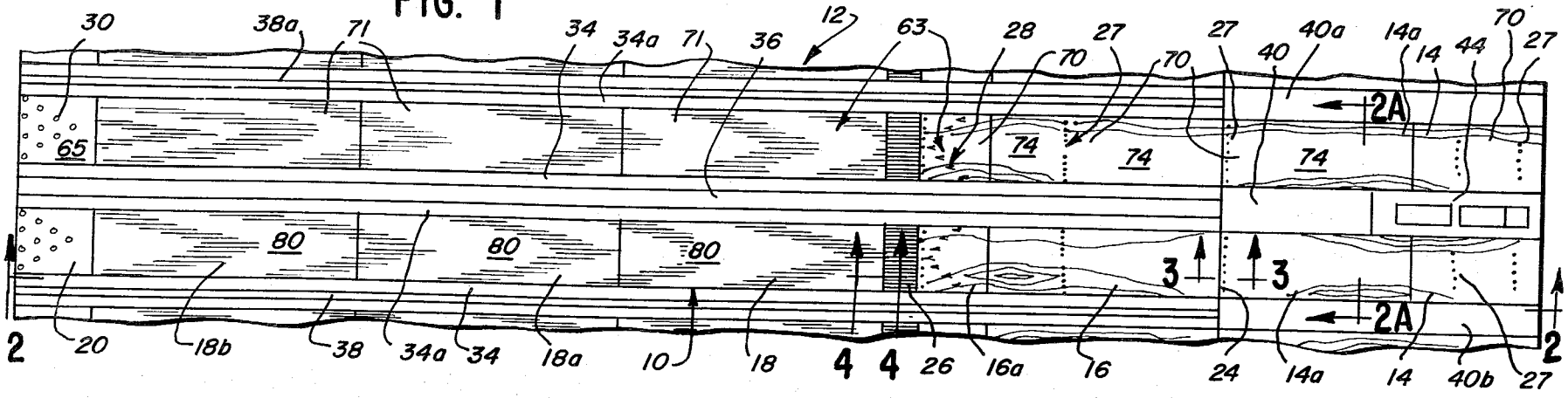
FIG. 1 is a top plan view of a pair of bowling lanes resurfaced according to the present invention.

Referring to FIG. 1, a pair of bowling lanes, generally designated 10 and 12, resurfaced according to the present invention are shown. Each lane 10 and 12 comprises a series of longitudinally extending lane sections conventionally referred to from forward to rear as approach sections 14 and 14*a*, head sections 16 and 16*a*, pine sections 18, 18*a* and 18*b*, and a pin deck 20. A transversely extending foul line 24 separates the rearmost approach section 14*a* and the forward head section 16, and a splice section 26 integral with the rearmost head section 16*a* abuts the forward pine section 18. The approach sections 14 and 14*a* and the head sections 16 and 16*a* have rangefinder dots 27 and arrows 28, and the pin deck 20 has pin spots 30.

A pair of longitudinally extending gutters 34 and 34*a* are disposed adjacent each lane 10 and 12 on opposite sides thereof, and a ball return tunnel 36 separates the right-hand gutter 34*a* of the lane 10 and the left-hand gutter 34 of the lane 12. Relatively narrow filler strips 38 and 38*a* separate the gutters 34 and 34*a* of the lanes 10 and 12 from those of additional lanes (not shown) adjacent thereto.

Filler sections 40, 40*a* and 40*b* and a ball return mechanism 44, shown schematically, separate the approach sections 14 and 14*a* of the lanes 10 and 12 from each other and from the approach sections of adjacent lanes.

Figure 2:
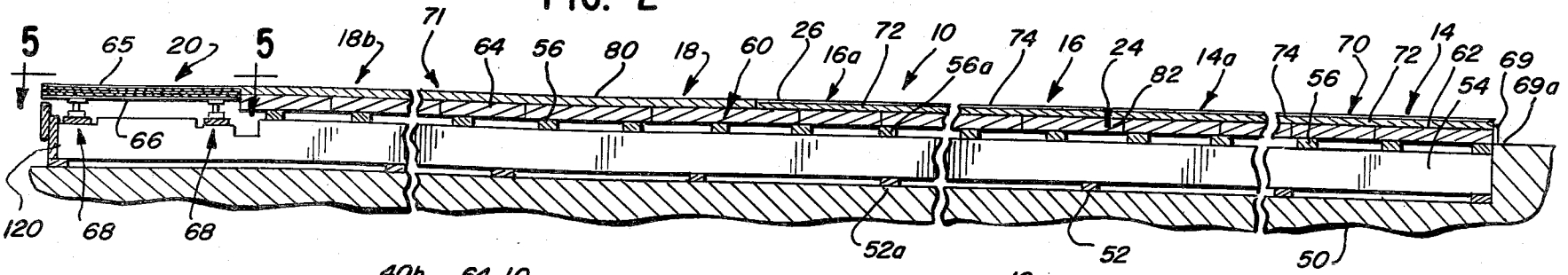
FIG. 2 is a fragmentary sectional elevation of a lane of FIG. 1 taken approximately along the line 2—2 of FIG. 1.
Figure 2A:
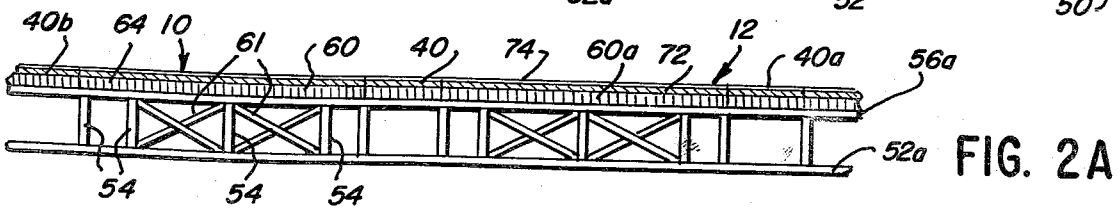
FIG. 2A is a sectional elevation of a lane of FIG. 1 taken approximately along line 2A—2A of FIG. 1.

Referring to FIGS. 2 and 2A, the supporting structure of the lanes 10 and 12 is shown. A concrete or similar foundation 50 supports a plurality of longitudinally spaced, transversely extending 2×4 wooden sleepers 52 which in turn support a plurality of transversely spaced, longitudinally extending upright 2×10 wooden stringers 54. A plurality of longitudinally spaced, transversely extending 2×4 wooden levelers 56 are supported by the stringers 54 and in turn support pre-existing wooden lanes 60 and 60*a*, corresponding to the lanes 10 and 12, respectively. As seen in FIG. 2A, pairs of stringers 54 located directly under each wooden lane 60 and 60*a* may be braced by longitudinally spaced pluralities of cross members 61 extending diagonally between associated vertically aligned pairs of levelers 56*a* and sleepers 52*a*.

The horizontal upper surface 62 of each lane 60 and 60*a* supports a synthetic lane surface, generally designated 63, to be described in detail below. Each lane 60 and 60*a* comprises a transversely laminated plurality of longitudinally extending wooden strips 64, of random lengths, in end-to-end alignment. The strips 64 are secured to each other by metal joining members (not shown), such as transversely extending nails, and by adhesives.

The approach and head sections 14–16*a* of the pre-existing wooden lanes 60 and 60*a* are of relatively hard maple, and the sections 18–18*b* are of relatively soft pine. The original splice section 26 of each lane 60 and 60*a* is of alternating maple and pine strips extending from the rearmost head section 16*a* and the forward pine section 18, respectively.

The pin deck 20 is a highly impact- and abrasion-resistant laminate of high-density resin-bonded particle board or fiber board coated on its respective upper and lower surfaces 65 and 66 with a melamine/cellulose and paper laminate, as described below in connection with the synthetic lane surface 63. The pin deck 20 is supported by adjustable leveling means 68 supported by the stringers 54. The pin deck 20 and its supporting structure are described in detail below with reference to FIGS. 6 and 7. The forward end of the wooden lanes 60 and 60*a* terminates in a transversely extending base molding 69 and shoe molding 69*a*.

The synthetic lane surface 63 comprises a series of two types of longitudinally extending synthetic panels 70 and 71 corresponding to the maple approach and head sections 14–16*a*, and the pine sections 18–18*b*, respectively. The filler sections 40–40*b* also comprise panels 70.

Each of the panels 70 comprises a two-element laminate including an underlayment section 72 of a suitable impact-absorbing material, such as a high-density phenol-formaldehyde resin-bonded particle board, having respective flat upper and lower surfaces 73 and 73*a*, supported by and secured to the wooden surface 62, as by a contact adhesive. Aligned with and secured to the upper surface 73 of each underlayment panel 72 is a plastic laminate panel 74, to be described in detail below.

The pine panels 71 are each of intermediate-density resin-bonded particle board or fiber board having a decorative printed upper surface 80 sealed with several coats of an impact- and abrasion-resistant polyurethane. Each panel 71 is aligned with and secured to the wooden lane surface 62, as by contact adhesive.

The foul line 24, to be described below, is received by a transverse groove 82 in the wooden substrate 60 and extends upwardly therefrom and between the approach section 14*a* and the head section 16.

Figure 4:
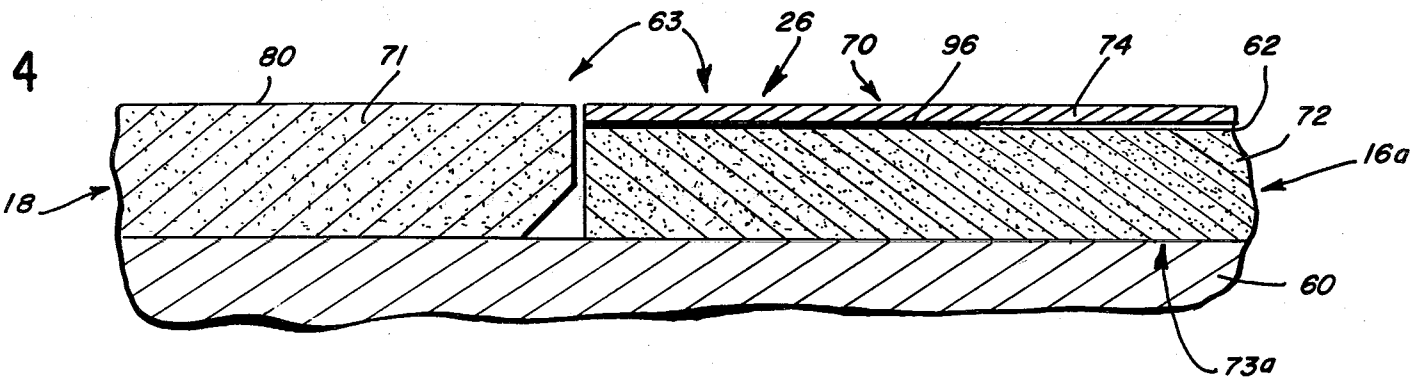
FIG. 4 is an enlarged sectional elevation of portions of a head and pine section of a lane of FIG. 1 taken approximately along line 4—4 of FIG. 1.

Referring now to FIG. 4, the maple and pine panels 70 and 71, respectively, will be described in detail. The underlayment 72, pine panel 71 and laminate panel 74 are each prefabricated and brought to the lane construction site as separate components.

Each underlayment panel 72 comprises a material selected to have hardness, tensile strength and stiffness (elastic modulus) characteristics sufficient to uniformly distribute stress imparted by a lofted bowling ball from an overlying laminate panel 74 to the underlying lane 60 over a sufficiently wide area to prevent permanent deformation of the laminate 74 or the underlayment 72, which would result in cracking of, or other damage to, the laminate panel 74.

Though the underlayment panels 72 must be capable of resisting a wide range of lofted ball impact (due to the varying ball weights and loft heights encountered in use), the underlayment panels 72 must not absorb such excessive amounts of ball energy as to result in "dead" lanes having unnatural bowling characteristics.

Materials exhibiting characteristics falling within the following ranges are suitable for use in the underlayment panels 72 of the present invention:

Hardness: between about 2500 lb. (as measured by the Janka Hardness Test, ASTM D1037, ¶¶68–70) and about M100 Rockwell, as measured according to ASTM D785–65;

Internal Bond Strength (Tensile Strength) of greater than about 320 psi, as measured according to ASTM D1037, ¶¶28–33; and Elastic Modulus (bending) between about 400,000 psi and 1,300,000 psi, as measured according to ASTM D1037, ¶¶11–30.

The required thickness of a panel of material having specific characteristics within the ranges defined above is readily empirically determined. Density may typically range from 62–87 lb./ft.$^3$.

One material which has been found to provide an excellent underlayment material is a phenol-formaldehyde resin-bonded particle board marketed under the trademark Resincore I by Resinwood Division of Rodman Industries, Inc. of Marinette, Wis. Resincore I has a density of about 62–65 lb./ft.$^3$, internal bond strength of about 350 psi, a hardness of about 3,000 lb., and an elastic modulus of about 680,000 psi. The preferred thickness of underlayment panels of Resincore I is about ⅜ inch.

It has been found that conventional urea resin-bonded particle board or fiber board has insufficient internal bond strength (in the range of about 150–200 psi) to provide acceptable material for use as underlayment panels 72 in the practice of the present invention.

Each laminate panel 74 is extremely impact- and abrasion-resistant, and comprises a cellulose/melamine-formaldehyde/Kraft paper composite, similar to laminates marketed under the trademark Formica. The laminate 74 includes a layer of decoratively printed paper which simulates the appearance of maple, typically printed by a cylinder printer. Rangefinder dots 27 and arrows 28 are silk-screened on the printed paper.

The printed paper layer is impregnated with a melamine-formaldehyde polymer and then laminated between a core of several layers of phenol-formaldehyde-impregnated Kraft paper and a transparent top layer of melamine-formaldehyde-impregnated alpha-cellulose. After curing, the laminate thickness is between 1/16 inch and 3/32 inch, dependent upon the chosen number of Kraft paper layers.

Each pine section 71 comprises a panel of commercial grade intermediate-density (about 44 lb./ft.$^3$) resin-bonded particle board or fiber board. Since the pine sections **18–18*b*** receive minimal direct ball impact but, rather, rolling ball contact only, the support provided by the intermediate-density composite is sufficient to prevent surface damage. Further, intermediate-density particle board is relatively inexpensive and use thereof decreases overall resurfacing expense.

The upper surface 80 of each pine panel 71 comprises one or two opaque layers of lacquer or other coating, upon which is printed a simulated pine design. Several layers of an impact- and abrasion-resistant polyurethane, such as marketed by the assignee hereof under the trademark "Astrolane 100" cover the printed layer. Astrolane 100 brand polyurethane may be readily reapplied as required should the surface 80 become worn. Such a polyurethane coating involves no danger of fire or explosion such as encountered with the use of lacquer. Each panel 71 is between 7/16 inch and 15/32 inch thick, dependent upon the thickness of the laminate layers 74 to be used on the maple sections 14–16 and 40.

Panels 71 as described above have been found to exhibit exceptional dimensional stability and resistance to warping, due at least in part to their negligible tendency to absorb humidity. Flat surfaces 80 of such panels 71 are exceptionally true and provide uniform, readily reproducible bowling characteristics from lane to lane. The absence of grain from the surface 80 (as well as from the surface of laminate panels 74) contribute to uniformity and controllability of bowling characteristics. Further, the panels 71 are relatively economical to manufacture.

To prepare a wooden lane such as lane 60 for resurfacing, the wooden surface 62 must be smoothed to a substantially uniform level, as by sanding with a conventional rotary sander. The sanding should be performed so as to result in negligible longitudinal or transverse variations in level. After sanding and clearing of sawdust and other debris, the foul line 24, the pine panels 71, and the head, approach and filler underlayment panels 72 are installed, and the laminate panels 74 are secured to their associated underlayment panels 72. The foul line 24 comprises a laminated strip of several plies of a commercial grade of black vulcanized fiber (compressed gelatinized cotton material) having interply bond strength equal to or greater than the tensile strength of the plies in a direction parallel to the plane thereof.

After the wooden surface 62 is sanded, the foul line groove 82 is routed in the lane 60 to a predetermined depth chosen to receive the foul line 24 and to allow the foul line 24 to extend above the surface 62 a distance equal to the installed depth of the approach and head panels 70. The groove 82 is partially filled with a quantity of glue 84 and the foul line 24 is inserted therein. The foul line 24 preferably has two longitudinally extending surface grooves 86 on opposite sides thereof for retention of glue and consequent enhancement of bond strength.

Each underlayment panel 72 is secured to the wooden lane surface 62 by a contact adhesive, preferably applied to the wooden surface 62. A suitable adhesive is a neoprene-based adhesive with chlorinated solvents marketed by the Bostik Company.

The pine panels 71 are then applied to the lane surface 62 in a manner similar to the application of the underlayments 72 with the panel 71 of section 18 in abutment with the panel 72 of section **16*a*. Referring to FIG. 4, the spacing between the respective panels 71 and 72 of sections 18 and 16*a* is exaggerated for clarity. Pressure is applied to the pine panel upper surface 80 by any suitable means, such as a weighted roller, to ensure that the bond between the panel 71 and the lane surface 62** is secure.

Figure 5:
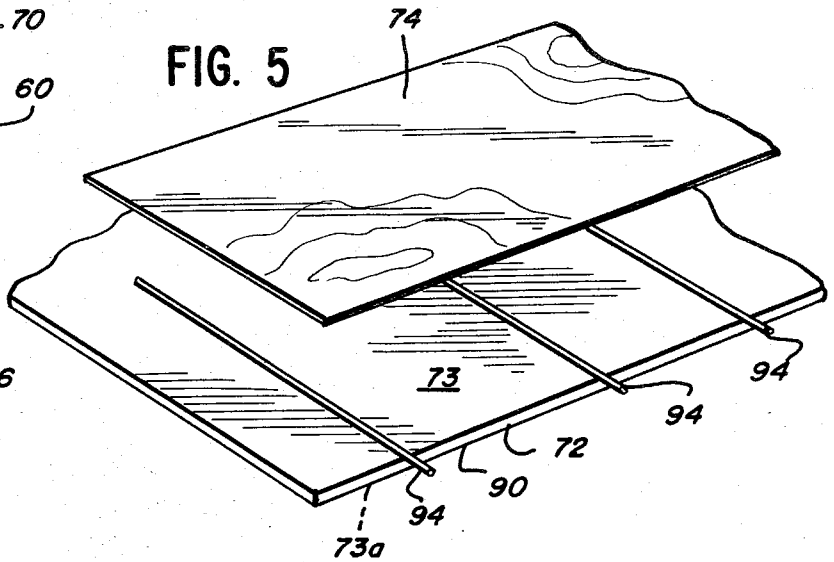
FIG. 5 is an exploded perspective showing a method of applying a surface laminate panel to an underlayment panel according to the present invention.
Figure 3:
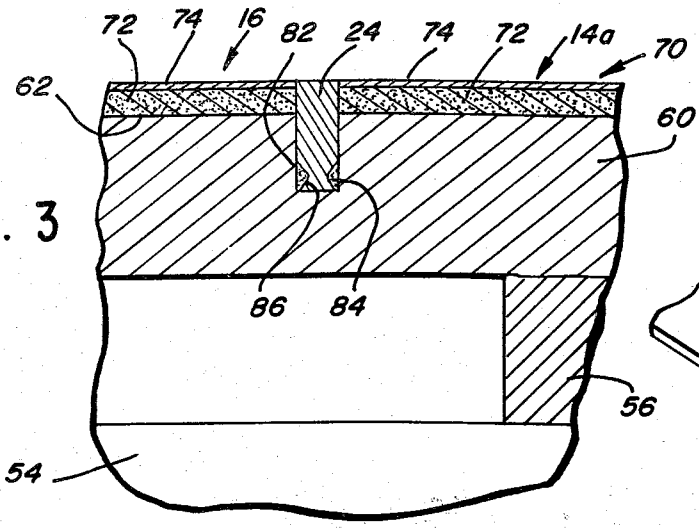
FIG. 3 is an enlarged sectional elevation of portions of the approach and head sections and the foul line of a lane of FIG. 1 taken approximately along line 3—3 of FIG. 1.

Referring to FIG. 5, a preferred method of aligning and securing a laminate panel 74 to an underlayment panel 72 is illustrated. After light sanding of the surface 73, adhesive is applied thereto and a plurality of temporary spacer means, such as dowel rods 94, are placed thereon with portions of the rods 94 extending outwardly of the panels 72 and 74, and the laminate panel 74 is carefully placed on the dowel rods 94 and aligned with the underlayment panel 72.

Since the panel 72 will become secured to the laminate panel 74 almost immediately upon contact of the surface 73 with the underside of the laminate 74, the panel 74 is aligned as closely as possible with the underlayment 72 and the dowel rods 94 are individually removed to ensure proper alignment of the panels 72 and 74. After the panel 74 has been applied to the panel 72, pressure is applied to the panel 74 by any suitable means, such as a weighted roller, to ensure that the bond between the panels 74 and 72 is secure.

It is to be noted that the thickness of each pine panel 71 is controlled during fabrication to be uniform and to closely approximate the installed thickness of the two-element panels 70, the elements 72 and 74 of which each are of a standardized, uniform thickness, to minimize longitudinal and transverse variations in surface level.

It is absolutely necessary that there be no rise in surface level in the forward-to-rear longitudinal direction of the lanes 10 and 12, and a drop of 0.015 inch between lane sections is the maximum allowable under American Bowling Congress regulations. After installation of the pine section panels 71, the surface level of the panels 70 may be controlled by placement of one or more very thin (0.005 inch) paper shims, such as shim 96 in FIG. 4 (spacing exaggerated for clarity), between the underlayment surface 73 and the laminate panel 74 before securing the panel 74 to the surface 73. Any resulting gap between the panels 74 and 72 is easily filled by adhesive.

It will be appreciated by those skilled in the art that on-site assembly of the synthetic laminate panels 74 to the underlayment panels 72 prevents pre-installation warping and consequent delamination of the panels 74 from the panels 72.

Figures 6, 7:
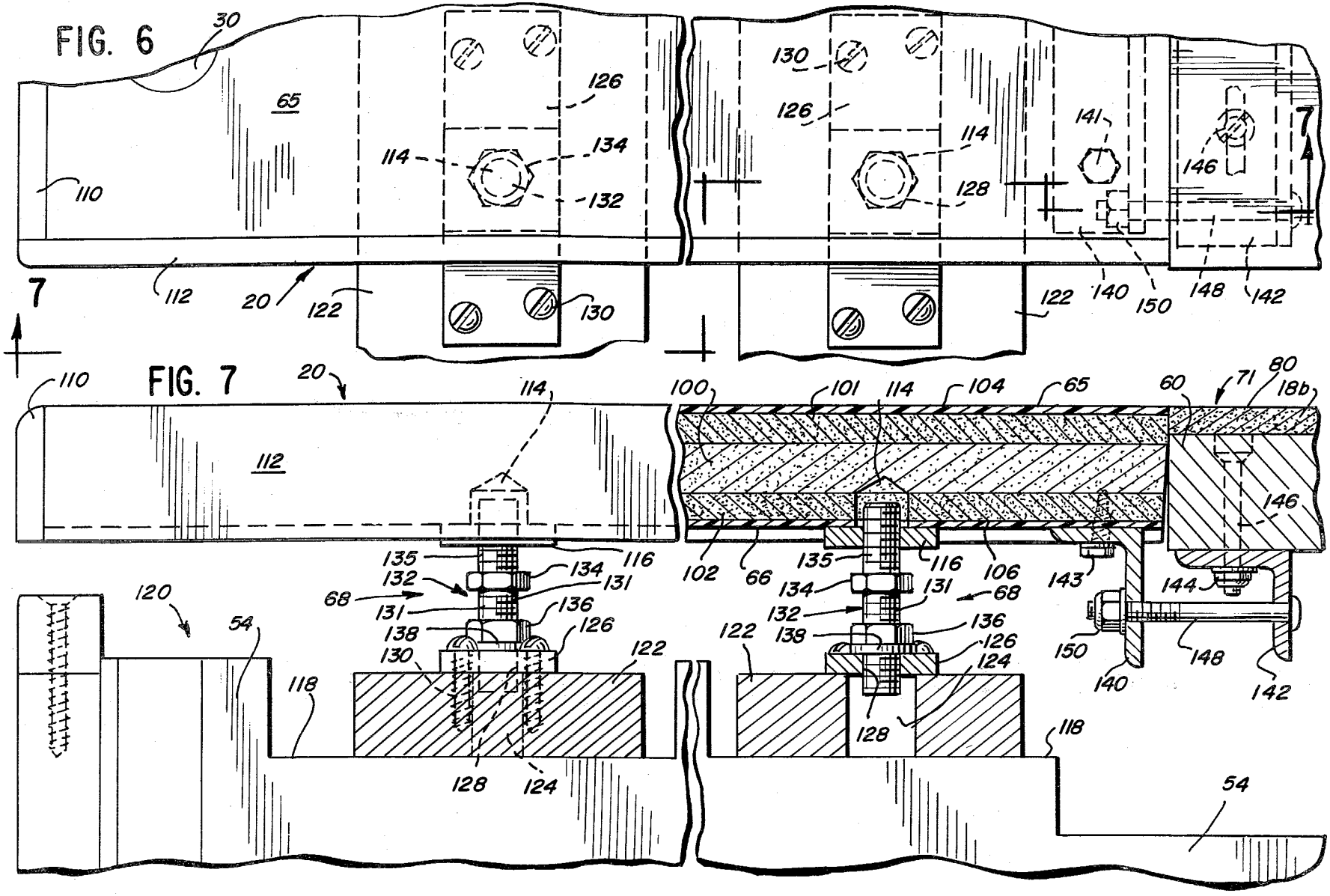
FIG. 6 is an enlarged fragmentary top plan view of the pin deck of a lane of FIG. 1 taken approximately along line 5—5 of FIG. 2, with some underlying support elements shown in phantom.
FIG. 7 is a sectional elevation of the pin deck and support elements of FIG. 6 taken approximately along line 7—7 of FIG. 6.

Referring now to FIGS. 6 and 7, the pin deck 20 and its associated supporting structure will be described in detail. The pin deck 20 comprises a pre-fabricated highly impact- and abrasion-resistant multi-layer laminate including a central core layer 100 disposed between respective upper and lower layers 101 and 102. Each layer 100–102 is illustratively of Resincore I resin-bonded particle board, or equivalent, similar to the underlayment panels 72. The respective upper and lower pin deck surfaces 65 and 66 comprise laminate panels 104 and 106 identical to the laminate panels 74. The upper panel 104 has pin spots 30 thereon.

It will be apparent to those skilled in the art that the pin deck 20 must be at least as abrasion- and impact-resistant as the lane panels 72 due to the extremely heavy impact forces applied to the pin deck 20 by bowling balls and pins during use.

The layers 100–106 are secured together by a suitable adhesive, such as a catalyzed vinyl glue, disposed between the respective layers. The symmetrical construction of the pin deck 20 prevents warping which would otherwise occur due to unequal expansion or contraction of the layers 100–106 caused by temperature and humidity effects.

After the layers 100–106 are secured together, the pin deck 20 is sized, and a suitable end cleat 110 and side cleats 112 are secured thereto. Two longitudinally spaced pairs of transversely spaced bores 114 are drilled in the lower surface 66 and a threaded nut 116 is secured thereover coaxially therewith.

After the panels 70 and 71 have been applied to the pre-existing wooden lane 60, the pin deck 20 may be installed. Extending between and secured to indented sections 118 of the stringers 54 at the rear end 120 thereof are 2×6 pads 122. Each pad 122 has a pair of laterally spaced clearance holes 124 alignable with the pin deck bores 114. A foot plate 126 having a threaded bore 128 is secured to each pad 122, as by screws 130, with each bore 128 coaxial with an associated clearance hole 124, and therefore aligned with the pin deck bores 114 and the nuts 116. The bores 128 are reverse threaded with respect to the nuts 116.

Threadedly received within each bore 128 is a threaded lower end 131 of an adjustable screw 132. Each screw 132 has a central hex head 134 and a threaded upper end 135. A jam nut 136 is threadedly received on the screw end 131, and a lock washer 138 is disposed on the screw end 131 adjacent the foot 125. The upper end of the screw 132 is threadedly received by the nut 116.

With the jam nut 136 positioned adjacent the hex head 134, the ends 131 and 135 of each adjusting screw 132 may be inserted into their associated nut and foot 116 and 126 by rotation of the screw 132. After said assembly, the level of the pin deck 20 may be adjusted by rotation of the screws 132 to eliminate longitudinal and transverse variations in the level of the pin deck surface 65 to position the pin deck surface 65 in substantial horizontal alignment with the lane surface 80.

After the surface level has been adjusted, each jam nut 136 may be positioned by rotation to tightly abut its associated lock washer 138 to prevent further rotation of the adjusting screws 132 in order to prevent undesirable dislocation of the pin deck 20 during use.

Two parallel, transversely extending angle brackets 140 and 142 are secured to the undersides of the pin deck 20 and the lane 60, respectively, adjacent the interface of the pin deck 20 and the lane 60. The bracket 140 is secured to the pin deck 20 by screws 143, and the bracket 142 is secured to the lane by a nut 144 receiving a machine screw 146 extending downwardly through the lane 60. A plurality of longitudinally extending, transversely spaced draw bolts 148 extend between the brackets 140 and 142 and each terminates in a hex head nut 150, tightening of which retains the lane 60 and the pin deck 20 in tight abutting relation to prevent inadvertent disassembly of the pin deck 20 from the lane 60 during use.

The resurfaced lane and method of construction of the same, as described above, exhibit several distinct advantages over prior bowling lane structure and methods of construction, and of course is more economical than removal and replacement of an entire wooden lane.

It has been found that the synthetic surfaces of the present invention exhibit enhanced resistance to impact, abrasion, fire and stain. The high-density approach and head underlayment panels result in enhanced resistance to surface damage from lofted and dropped bowling balls.

For example, a head section made as described above was found to resist visual surface damage from 20,000 impacts of a 16 lb. bowling ball lofted 16 inches above the surface, and similarly showed no visual surface damage from a 16 lb. ball dropped thereon from heights of up to 10 feet. In a test of wear resistance conducted according to the Standard National Electrical Manufacturer Association Test LD-3.301, the surface laminate 74 of a head section withstood 4,400 cycles on a Taber Abraser before wearing through. Prolonged application of a burning cigarette to the surface produced only minor discoloration which was easily wiped clean with no charring. Application of alcohol, detergent, shoe polish and mustard for periods up to 24 hours produced no stain.

Astrolane 100 brand polyurethane used to coat the pine sections **18–18*b*, is formulated to produce a surface which, with conventional maintenance, has a coefficient of friction and other characteristics similar to wooden bowling lane surfaces. It has further been found that conventionally maintained synthetic approach and head sections 14–16** of the invention have surface characteristics similar to those of conventional wooden lane surfaces and, as a result, lanes resurfaced according to the invention exhibit bowling characteristics comparable to those of wooden lanes. It may be appreciated that the standardized production of the decorative surfaces of the lane results in a uniform, yet natural, appearance.

Further, damaged or worn sections of bowling lanes resurfaced according to the invention may be removed and replaced, unlike prior wooden lanes which, due to the random strip structure thereof, are not subject to sectional replacement. Also, it has been found that bowling proprietors using the lane resurfacing method of the invention may experience a reduction in casualty insurance premiums of up to 10% due to the elimination of hazardous lacquers heretofore utilized in the resurfacing process.

The foregoing detailed description is given for clearness of understanding only, and no unnecessary limitations should be understood therefrom, as modifications within the scope of the invention will be obvious to those skilled in the art.

We claim:

1. A method of resurfacing the bowling surface of a worn bowling lane, comprising the steps of:

(a) smoothing said worn surface to a substantially uniform level;

(b) securing directly to said smoothed surface on an underlayment panel having a substantially flat, horizontal upper surface, said underlayment panel being of a phenolformaldehyde resin-bonded particle board material having a density of between about 62 and 87 lb/ft$^3$; and (c) securing directly to said underlayment panel upper surface a panel of a decorative, highly impact- and abrasion-resistant synthetic plastic laminate having a substantially flat, horizontal bowling surface, said underlayment panel being of a thickness and of a material selected to have hardness, tensile strength and stiffness characteristics sufficiently high to substantially uniformly distribute stress imparted by a bowling ball lofted onto said laminate panel bowling surface from said laminate panel to said wooden lane over an area sufficiently large to prevent permanent deformation of said laminate panel.

2. The method of claim 1 wherein said underlayment panel is of a material having a hardness of between about 2500 lb (Janka) and M100 (Rockwell), a tensile strength of greater than about 320 psi, and an elastic modulus of between about 400,000 psi and 1,300,000 psi.

3. The method of claim 2 wherein said material comprises particle board having a density of between about 62–65 lb/ft$^3$, a tensile strength of greater than about 350 psi, a hardness of about 3,000 lb. (Janka) and an elastic modulus of about 680,000 psi.

4. The method of claim 3 wherein said particle board panel has a thickness of about $\frac{3}{8}$ inch.

5. A method of resurfacing the bowling surface of a worn wooden bowling lane, comprising the steps of:

(a) smoothing said worn surface to a substantially uniform level;

(b) securing directly to said smoothed surface an underlayment panel having a substantially flat, horizontal upper surface; and (c) securing directly to said underlayment panel upper surface a panel of a decorative, highly impact- and abrasion-resistant synthetic plastic laminate having a substantially flat, horizontal bowling surface, said underlayment panel being of a phenol-formaldehyde resin-bonded particle board material having a hardness of between about 2500 lb. (Janka) and M100 (Rockwell), a tensile strength of greater than about 320 psi, and an elastic modulus of between about 400,000 psi and 1,300,000 psi, whereby stress imparted by a bowling ball lofted onto said laminate panel bowling surface is distributed substantially uniformly from said laminate panel to said wooden lane over an area sufficiently large to prevent permanent deformation of said laminate panel.

6. The method of claim 5 wherein the density of said particle board material is between about 62 and 87 lb/ft$^3$.

7. The method of claim 6 wherein said particle board material has a density of between about 62–65 lb/ft$^3$, a tensile strength of greater than about 350 psi, a hardness of about 3,000 lb. (Janka) and an elastic modulus of about 680,000 psi.

8. The method of claim 7 wherein said particle board panel has a thickness of about $\frac{3}{8}$ inch.

9. A bowling lane comprising:

(a) a substantially flat, horizontal supporting surface;

(b) an underlayment panel secured directly to said supporting surface and having a substantially flat, horizontal upper surface; and, (c) a decorative, highly impact- and abrasion-resistant plastic laminate panel secured directly to said underlayment panel upper surface and having a flat, substantially horizontal bowling surface, said underlayment panel being of a phenol-formaldehyde resin-bonded particle board material having a density of between about 62 and 87 lb/ft$^3$ and of a thickness such that said underlayment panel has hardness, tensile strength and stiffness characteristics sufficiently high to substantially uniformly distribute stress imparted by a bowling ball lofted onto said laminate panel bowling surface from said laminate panel to said supporting surface over an area sufficiently large to prevent permanent deformation of said laminate panel.

10. The bowling lane of claim 9 wherein said underlayment panel is of a material having a hardness of between about 2500 lb (Janka) and M100 (Rockwell), a tensile strength of greater than about 320 psi, and an elastic modulus of between about 400,000 psi and 1,300,000 psi.

11. The bowling lane of claim 10 wherein said material comprises particle board having a density of between about 62–65 lb/ft$^3$, a tensile strength of greater than about 350 psi, a hardness of about 3,000 lb. (Janka) and an elastic modulus of about 670,000 psi.

12. The lane of claim 11 wherein said particle board panel has a thickness of about ⅜ inch.

13. A bowling lane comprising:

(a) a substantially flat, horizontal supporting surface;

(b) an underlayment panel secured directly to said supporting surface and having a substantially flat, horizontal uppder surface; and, (c) a decorative, highly impract- and abrasion-resistant plastic laminate panel secured directly to said underlayment panel upper surface and having a flat, substantially horizontal bowling surface, said underlayment panel being of a phenol-formaldehyde resin-bonded particle board material having a hardness of between about 2500 lb. (Janka) and M100 (Rockwell), a tensile strength of greater than about 320 psi, and an elastic modulus of between about 400,000 psi and 1,300,000 psi, whereby stress imparted by a bowling ball lofted onto said laminate panel bowling surface is distributed substantially uniformly from said laminate panel to said wooden lane over an area sufficiently large to prevent permanent deformation of said laminate panel.

14. The bowling lane of claim 13 wherein said density of said particle board material is between about 62 and 87 lb/ft$^3$.

15. The bowling lane of claim 14 wherein said particle board material has a density of between about 62–65 lb/ft$^3$, a tensile strength of greater than about 350 psi, a hardness of about 3,000 lb. and an elastic modulus of about 680,000 psi.

16. The bowling lane of claim 15 wherein said particle board panel has a thickness of about ⅜ inch.

17. A method of resurfacing the bowling surface of a worn bowling lane, comprising the steps of:

(a) smoothing said worn surface to a substantially uniform level;

(b) securing directly to said smoothed suface an underlayment panel defining a substantially flat, horizontal upper surface, said underlayment panel being of a phenol-formaldehyde resin-bonded particle board material having a density of between about 62 and 65 lb/ft$^3$; and (c) securing directly to said underlayment panel upper surface a panel of a decorative, highly impact- and abrasion-resistant synthetic plastic laminate defining a substantially flat, horizontal bowling surface, said underlayment panel being of sufficient thickness and of a material selected to have hardness characteristics sufficient to substantially uniformly distribute stress imparted by a bowling ball lofted onto said laminate panel bowling surface from said laminate panel to said lane over an area sufficiently large to prevent permanent deformation of said laminate panel.

18. The method of claim 17 wherein said particle board panel has a thickness of about ⅜ inch.

19. A bowling lane comprising:

(a) a substantially flat, horizontal supporting surface;

(b) an underlayment panel secured directly to said supporting surface and having a substantially flat, horizontal upper surface; and, (c) a decorative, highly impact- and abrasion-resistant plastic laminate panel secured directly to said underlayment panel upper surface and defining a flat, substantially horizontal bowling surface, said underlayment panel being of a phenol-formaldehyde resin-bonded particle board material having a density of between about 62 and 65 lb/ft$^3$ and having thickness and hardness characteristics sufficient to substantially uniformly distribute stress imparted by a bowling ball lofted onto said laminate panel bowling surface from said laminate panel to said supporting surface over an area sufficiently large to prevent permanent deformation of said laminate panel.

20. The bowling lane of claim 19 wherein said underlayment panel has a thickness of about ⅜ inch.

21. A bowling lane having a surface characterized by a high falling ball impact resistance, a coefficient of friction approximately that of a wooden bowling lane, and a high abrasion resistance, said bowling lane comprising at least one decorative plastic laminate panel adhered to a substrate, said substrate comprising a high density phenol-formaldehyde resin-bonded particle board material having a density of at least about 60 lb/ft$^3$.

* * * * *